United States Patent [19]

Lüebbers

[11] 3,995,556

[45] Dec. 7, 1976

[54] PERCUSSION FUSE FOR AN EXPLOSIVE MUNITIONS SHELL

[75] Inventor: Willi Lüebbers, Trittau, Germany

[73] Assignee: Hanns-Juergen Diederichs KG, Trittau, Germany

[22] Filed: June 4, 1975

[21] Appl. No.: 583,852

[30] Foreign Application Priority Data

June 4, 1974 Germany ..... 2426838

[52] U.S. Cl. ..... 102/73 R; 102/76 R

[51] Int. Cl.[2] ..... F42C 1/00

[58] Field of Search ..... 107/70 R, 73 R, 76, 107/78, 79, 80

[56] References Cited

UNITED STATES PATENTS

| | | | |
|---|---|---|---|
| 2,487,056 | 11/1949 | King | 102/70 R |
| 2,981,192 | 4/1961 | Grandy | 102/78 |
| 3,576,165 | 4/1971 | Gawlick | 102/76 R |
| 3,623,432 | 11/1971 | Schminke | 102/76 R |
| 3,724,385 | 4/1973 | Beatty | 102/78 |

FOREIGN PATENTS OR APPLICATIONS

| | | | |
|---|---|---|---|
| 48,989 | 7/1934 | Denmark | 102/80 |
| 1,179,835 | 10/1964 | Germany | 102/80 |
| 166,152 | 2/1959 | Sweden | 102/70 R |

*Primary Examiner*—Harold Tudor

[57] ABSTRACT

An improved percussion fuse for a mortar or similar explosive munitions shell is described. The fuse body that interconnects the charge-carrying shell body with the shell head disposed forwardly thereof has a sleeve portion in which a radial bore is disposed. A conventional impact member that carries the percussion fuse and that is slidable axially within the sleeve has a mating, V-shaped groove that cooperates with the bore in the sleeve to normally retain a locking sphere therein; such locking sphere normally prevents the forward movement of the impact member against the primer that is carried at the rear portion of the shell head. An easily puncturable, membrane-like closure member is disposed over the bore in the sleeve portion of the impact member to retain the blocking sphere in its seated position after the shell cartridge has been separated from the shell during the firing operation. During deceleration of the fired shell, the groove in the impact member moves forwardly to cam the captured blocking sphere in a radially outward direction, whereupon the latter punctures the closure member and escapes. Accidental detonation of the fired shell during an initial portion of the shell trajectory is prevented by the provision of a pair of offset recesses in the confronting surfaces of the impact member and the shell head, the radial interface between such recesses serving to prevent the percussion cap in the impact member from contacting the primer.

10 Claims, 4 Drawing Figures

PERCUSSION FUSE FOR AN EXPLOSIVE MUNITIONS SHELL

BACKGROUND OF THE INVENTION

The invention relates to percussion fuses for explosive munitions shells such as mortar shells.

Conventional percussion fuse assemblies associated with mortar and other explosive munitions shells include a fuse body that interconnects the charge-carrying shell body with the shell head that is disposed forwardly of the shell body and which contains the fuse primer. The percussion cap that cooperates with the primer to detonate the charge upon shell impact, is slidably disposed within a projecting sleeve portion of the fuse body.

In order to prevent the movement of the percussion cap against the primer prior to impact of the shell, the impact member is removably secured to the overlying shell by means of at least one blocking sphere that is seated between mating grooves and bores in the periphery of the impact member and the sleeve member. In conventional designs of this type, the separable cartridge of the unfired shell extends over the outer periphery of the impact member, thereby serving to prevent the outward propulsion through the bore of the blocking sleeve. When the shell is fired within the associated weapon, the shell separates from the cartridge, whereby the blocking sphere moves outwardly through the now-open bore to bear against the inner surface of the barrel of the weapon during the further travel of the shell therethrough. The repeated rubbing of the blocking members of successive shells through the weapon establishes longitudinal grooves along the barrel, which lead to a decrease in the effective operating life of the weapon and additionally provides a leakage path for the gas pressure necessary for the firing of the weapon. The resulting diminution of gas pressure within the barrel also leads to a decrease in firing efficiency of the weapon.

Additionally, in conventional designs of this type, a helical spring or the like normally separates the front of the impact member from the rear surface of the shell head, such spring cooperating with a second inertial sphere carried in a recess at the front of the impact member to normally prevent the percussion cap from contacting the primer. Such designs have been found to be susceptible to malfunctions and premature firing, since the inertial sphere is frequently caught in the turns of the separation spring and is thereby prevented from accomplishing its desired purpose.

SUMMARY OF THE INVENTION

These disadvantages are overcome with the improved percussion fuse of the present invention, which is adapted for applications similar to that discussed above in connection with mortar or other explosive munitions shells. In an illustrative embodiment, a puncturable, membrane-like closure member is disposed in overlying relation to the bore in the shell portion of the impact member to confine the blocking sphere against radial outward movement against the weapon barrel after the cartridge has been separated from the shell during firing. Such closure member serves to confine the blocking sphere during the acceleration portion of the shell trajectory after the shell has left the weapon, thereby maintaining the sphere in its blocking position to prevent premature detonation of the shell. Upon impact, the initial tendency of the impact member to move forwardly cams the impact member outwardly, so that the latter punctures the closure member to fly out of the fuse and thereby release the percussion cap for forward movement against the primer.

In order to prevent the blocking sphere from puncturing the closure member to release the impact member when the shell head contacts an obstacle and thereby decelerates during the first portion of its flight, a pair of radially offset recesses are provided in the front surface of the impact member and the rear surface of the shell head, respectively. The above-mentioned inertial sphere is normally engaged by the recess in the impact member; and during the normal deceleration portion of the flight, the sphere moves inertially into the recess of the shell head, to permit the subsequent forward movement of the impact member at the time of impact. If an obstacle such as camouflage, leaves or the like is met during the first portion of the shell trajectory before the inertial sphere has moved forwardly into the recess in the shell head, such sphere will be compressed between the now forwardly-moving impact member and the interface between the radially offset recesses in the impact member and the shell head. Such compression will stop the further movement of the impact member, thereby preventing the percussion cap from engaging the primer.

BRIEF DESCRIPTION OF THE DRAWING

The invention is further set forth in the following detailed description taken in conjunction with the appended drawing, in which.

DETAILED DESCRIPTION

Figure 1:
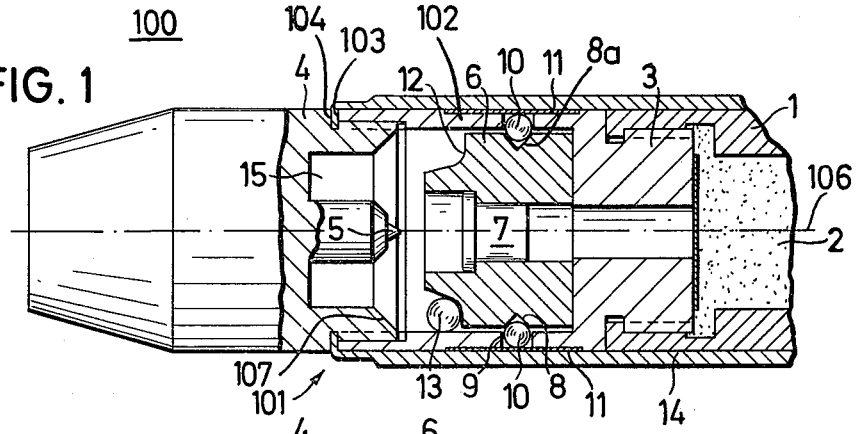
FIG. 1 is a longitudinal view, partially in section, of an explosive munitions shell containing an improved percussion fuse in accordance with the invention, the shell being shown disposed in its separable cartridge prior to firing.

Referring now to the drawing, FIG. 1 illustrates the front portion of an unfired, explosive munitions shell, illustratively a mortor shell, having an improved percussion fuse assembly 101 constructed in accordance with the invention. The shell 100 includes a main shell body 1 that contains a conventional explosive charge 2. The shell further includes a shell head 4 that is disposed forwardly of and in spaced relation to the main shell body 1.

A fuse body 3 of the fuse assembly 101 threadedly interconnects the front portion of the shell body 1 with the rear portion of the shell head 4. The fuse body 3 has a forwardly projecting sleeve portion 102 whose front end 103 cooperates with a shoulder 104 on the fuse head 4 to receive an inwardly crimped end of a shell cartridge 14, which extends along and overlies the outer periphery of the sleeve portion 102. The cartridge 14 is conventionally adapted to separate from the shell 100 when the latter is fired.

An impact member 6 is lockably received within the sleeve portion 102 for sliding movement along the shell axis (designated 106) between the rearmost rest position illustrated in FIG. 1 and a frontmost impact position, described below.

A conventional primer 5 is disposed coaxially in and extends rearwardly from the rear surface of the shell head 4. The primer 5 is disposed in aligned igniting relation with a percussion cap 7 carried by the impact member 6. Upon the engagement of the primer 5 by the percussion cap 7, an ignition ray shoots rearwardly from the cap 7 to detonate the charge 2 in the shell body 1 in a conventional manner.

The impact member 6, and thus the percussion cap 7, is normally maintained in spaced relation from the primer 7 by means of a locking arrangement that serves to constrain the impact member 6 in its rearward position. The blocking arrangement includes a pair of radial bores 9—9 extending through and disposed 180° apart around the periphery of the sleeve member 102. An annular, V-shaped groove 8 is disposed around the periphery of the impact member 6, and is aligned with the radial grooves 9 in the sleeve member 102 when the impact member 6 is in its rearmost position shown in FIG. 1. A pair of blocking spheres 10—10 are individually captured between the grooves 8 and the respective bores 9—9.

The fuse assembly 101 further comprises a second inertial sphere 13 which is normally in engagement with a peripheral recess 12 disposed in the front surface of the impact member 6. As explained below, during deceleration of the shell 100 after firing, the sphere 13 travels slowly in the forward direction from its normal position in the recess 12. As an additional feature of the disclosed fuse assembly, the rear surface of the shell head 4 is provided with an annular recess 15 coaxial with and surrounding the primer assembly 5 for receiving the sphere 13 at the end of the forward travel of the latter. The annular recess 15 is radially offset from the recess 12 of the impact member 6, so that a chamfered interface region 107 on the shell head 4 is in axial alignment with the recess 12 of the impact member 6. The taper on the portion 107 is in a direction to aid the movement of the sphere 13 toward the bottom of the recess 15.

Figure 2:
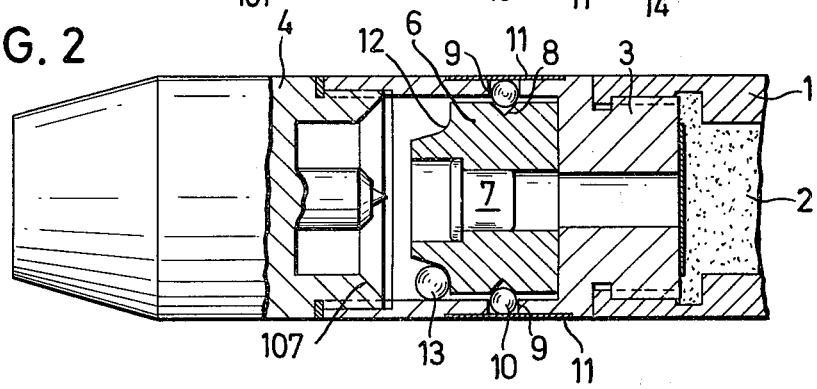
FIG. 2 is a longitudinal view similar to FIG. 1, but illustrating the shell and fuse assembly during the first portion of its trajectory after being fired.

Overlying the outer periphery of each of the radial bores 9 in the sleeve member 102 is a puncturable, membrane-like closure element 11 which, as indicated below, serves to retain the blocking sphere 10 in its illustrated seated position during the firing of the shell 100 and during the acceleration portion of its subsequent trajectory toward its target. This expedient prevents the interior wall of the barrel of the associated weapon from being longitudinally grooved by contact with the blocking sphere 10 after the cartridge 14 is separated from the shell 100 during firing, as illustrated best in FIG. 2. Consequently, the reduction in accuracy, efficiency, and long life of the firing weapon, which resulted from the formation of such longitudinal grooves in the past, is completely obviated.

The closure member 11 may illustratively be formed from paper, plastic, or metallic foil. Alternatively, it may be formed from a paraffin-like lacquer, or from any other material that may be efficiently adhered to the outer periphery of the sleeve member 102. All that is necessary is that the material selected be sufficiently strong so as to retain the blocking sphere 10 in the position shown in FIG. 1 while the impact member 6 is at rest, while being sufficiently easily puncturable so that the radial outward propulsion of the blocking sphere 10 upon a slight forward camming movement of an inclined rear surface **8*a* of the groove 8 is effective to rupture the closure member 11 and permit the escape of the sphere 10**.

Figure 3:
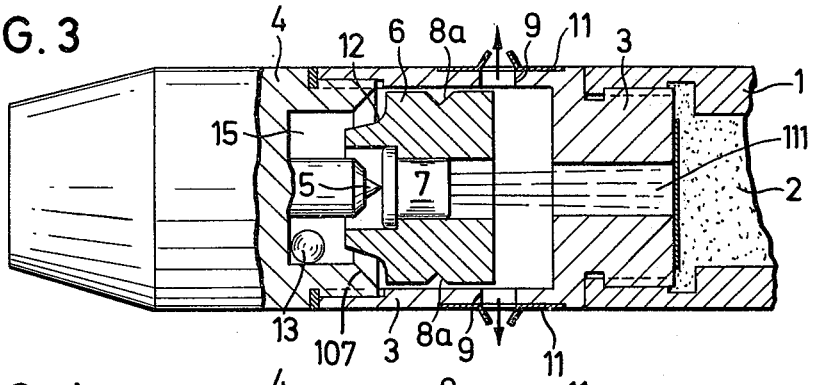
FIG. 3 is a longitudinal view of the shell and fuse assembly of FIGS. 1 and 2 upon impact with a desired target and consequent detonation of the charge within the shell.
Figure 4:
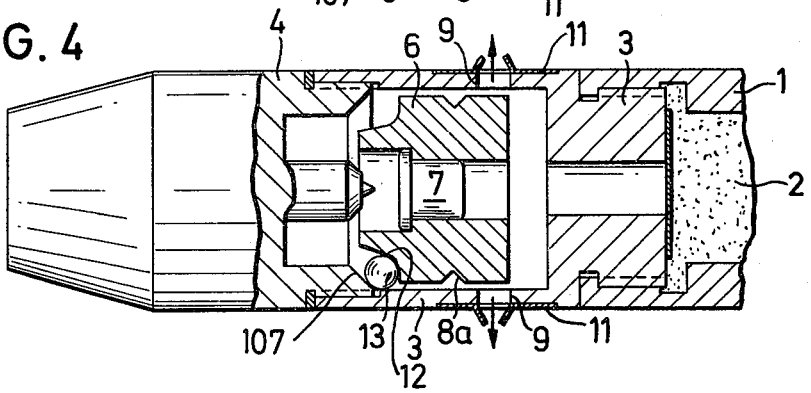
FIG. 4 is a longitudinal view of the shell of FIGS. 2–3, illustrating the internal conditions of the fuse upon the contact of the shell head with an obstacle during the first portion of the shell trajectory.

The above-described percussion fuse assembly 101 operates as follows:

Prior to firing of the shell 100, the impact member 6, and thereby the percussion cap 7, is maintained in spaced relation to the primer 5 by the locking arrangement including the sphere 10 and the mating holes 8 and 9. Upon firing, the cartridge 14 is separated from the shell 100, and during the acceleration phase of the shell trajectory, the sphere 10 is locked in position by means of the overlying closure member 11. During such acceleration phase, the inertial sphere 13 tends to maintain itself in contact with the recess 12 in the impact member 6. During a subsequent portion of the trajectory, when the air resistance starts to decelerate the shell head 104, the sphere 13 will tend to inertially move forward from the position illustrated in FIG. 2 and into the recess 15 of the shell head 4 via the sloped portion 107. Upon the impact of the shell head 4 with the intended target, the sudden deceleration of the shell will cause the impact member 6 to start to move forward, whereby the camming surface **8*a* of the groove 8 will cause the blocking sphere 10 to puncture the closure member 11 and to escape from the fuse. At this point, the impact member 6 is free to travel forwardly until the percussion cap 7 contacts the primer 5, whereupon the resulting ignition ray 111 detonates the charge 2 to explode the shell. If an obstacle, such as a camouflage net, leaves, or the like, are interposed in the path of the shell trajectory during the first or acceleration portion thereof, the resulting braking effect on the impact member 6 will, as in the impact situation of FIG. 3, cause the surface 8*a* to move forward somewhat and to propel the blocking sphere outwardly through the puncturable closure member 11. However, because of the combination of (a) the radially offset disposition of the recesses 12 and 15 in the impact member 6 and the shell head 4 and (b) the tendency of the inertial sphere 13 to remain at or near the recess 12 during the acceleration phase of the trajectory, the forward movement of the impact member 6 upon the releasing of the blocking sphere 10 will serve only to squeeze the inertial sphere 13 against the offset portion 107 of the shell head 4, thereby preventing the impact member 6 from moving all the way forward into the impact position. Accordingly, the construction provided by the instant invention not only leads to an improved operating life and efficiency of the barrel of the weapon firing the shell 100**, but also yields an effectively "fail-safe" condition of the fused shell during storage, handling and operation.

Although only one illustrative embodiment of the invention has been set forth in the foregoing description, many variations and modifications thereof will now occur to those skilled in the art. It is accordingly desired that the scope of the appended claims not be limited to the specific disclosure herein contained.

What is claimed is:

1. In an explosive munitions shell disposed in a cartridge separable upon firing of the shell and having a charge-containing shell body and a shell head disposed forwardly of and in spaced relation to the shell body, an improved percussion fuse assembly which comprises, in combination, a fuse body interconnecting the shell body and the shell head, the fuse body having a fixed sleeve portion containing at least one radial bore therethrough and an impact member lockably supported for axial movement in the sleeve portion between a rearmost rest position and a frontmost impact position, a percussion cap carried by the impact member, a primer extending rearwardly from the rear surface of the shell head and engageable with the percussion cap when the impact member is in its frontmost position, the impact body having a substantially V-shaped annular groove disposed in the periphery thereof in radial alignment with the first bore of the sleeve member when the impact member is in its rearmost position, a first blocking sphere seatable in the aligned first bore and peripheral groove to normally prevent substantial forward motion of the impact member, and a puncturable closure membrane disposed over each first bore of the sleeve portion in contact with the associated first sphere to normally confine the associated first sphere in its seated position, and to thereby normally maintain the impact member in its rearmost position, after the cartridge is separated.

2. Apparatus as defined in claim 1, in which the shell head has a first recess in the rear surface thereof, in which the impact member has a second recess in the front surface thereof, and in which the fuse assembly further comprises a second sphere normally disposed in the second recess of the impact member, the second sphere being movable inertially from the second recess toward the first recess during a deceleration of the shell.

3. Apparatus as defined in claim 2, in which the second recess in the impact member is radially displaced from the first recess in the shell head.

4. Apparatus as defined in claim 1, in which the closure member is formed from metal foil.

5. Apparatus as defined in claim 1, in which the closure member is formed from plastic foil.

6. Apparatus as defined in claim 1, in which the closure member is formed from paper foil.

7. Apparatus as defined in claim 1, in which the closure member is formed from a paraffin lacquer.

8. Apparatus as defined in claim 1, in which the closure member is adhesively secured to the outer surface of the sleeve member.

9. Apparatus as defined in claim 1, in which the sleeve member has a pair of the first bores disposed 180° apart on the periphery of the sleeve member.

10. Apparatus as defined in claim 1, in which the cartridge, before separation, extends axially over the first bore of the sleeve portion to overlie the closure member thereon.

* * * * *